United States Patent [19]

Coleman et al.

[11] 4,301,105

[45] Nov. 17, 1981

[54] PROCESS FOR SPINNING POLY(POLYMETHYLENE TEREPHTHALAMIDE) FIBER

[75] Inventors: Denis Coleman, Stamford, Conn.; Edwin J. Siegman, Pensacola, Fla.

[73] Assignee: American Cyanamid Company, Stamford, Conn.

[21] Appl. No.: 142,278

[22] Filed: Apr. 21, 1980

[51] Int. Cl.[3] ..... D01F 6/00

[52] U.S. Cl. ..... 264/205; 260/29.2 N; 264/211; 264/210.6

[58] Field of Search ..... 264/203, 210.6, 205, 264/211, 176 F; 260/29.2 N

[56] References Cited

U.S. PATENT DOCUMENTS

| | | | |
|---|---|---|---|
| 3,324,061 | 6/1967 | Tanquavy et al. | 260/29.2 N |
| 3,542,715 | 11/1970 | White et al. | 264/205 |
| 3,885,014 | 5/1970 | Fukada et al. | 264/176 F |
| 3,991,153 | 11/1976 | Klausner et al. | 264/176 F |
| 4,220,617 | 9/1980 | Pfeiffer et al. | 425/464 |

FOREIGN PATENT DOCUMENTS

| | | | |
|---|---|---|---|
| 47-46601 | 11/1972 | Japan | 264/211 |

*Primary Examiner*—Jay H. Woo

*Attorney, Agent, or Firm*—Frank M. Van Riet

[57] ABSTRACT

Extruding a homogeneous single phase fusion melt of a poly(polymethylene phthalamide) and water through a spinneret to form filaments and stretching the resulting filaments provides fiber of desirable physical properties without significant lowering of the molecular weight of the polymer forming the fiber.

5 Claims, No Drawings

PROCESS FOR SPINNING POLY(POLYMETHYLENE TEREPHTHALAMIDE) FIBER

This invention relates to an improved process for preparing fiber from poly(polymethylene terephthalamides). More particularly, this invention relates to such a process wherein a single phase fusion melt of poly(polymethylene terephthalamide) and water is extruded through a spinneret, stretched to provide molecular orientation and further processed as desired to provide fiber of attractive physical properties.

Poly(polymethylene terphthalamide) represents a class of nylons that have very high melting and second order transition temperatures that make it potentially useful as fiber for use as tire cords and in the apparel field such as in the fabrication of permanent-press textiles. Poly(hexamethylene terephthalamide, otherwise referred to as nylon 6T, is particularly attractive for such uses and represents a preferred species of this generally class.

Nylon 6T has a melting point of 371° C. When this polymer is heated to temperatures approaching its melting point, decomposition of the polymer occurs before a useful melt is obtained. Previous methods for spinning this polymer were wet spinning procedures using concentrated sulfuric acid as the polymer solvent and coagulating the polymer in aqueous medium. Formation of dilute sulfuric acid in the coagulation bath was considered to be responsible for hydrolysis of the polymer and substantial loss of molecular weight. Thus, although the concentrated sulfuric acid used to dissolve the polymer did not appear to lower the molecular weight of the polymer, the use of water in coagulating medium caused substantial reduction of the molecular weight.

However, because of the unattractive nature of concentrated sulfuric acid as the polymer solvent and other problems associated with spinning of nylon 6T and related polymers, there has been limited interest in fiber obtained from such polymers in spite of their potential benefits.

In order to promote fiber of this polymer class and realize its potential benefits, it is necessary to provide a process for making such fiber which avoids deficiencies of the former processes. Such a provision would satisfy a long-felt need and constitute a significant advance in the art.

In accordance with the present invention, there is provided a process for preparing fiber which comprises preparing a homogeneous single phase fusion melt of a poly(polymethylene terephthalamide) and water at a temperature above the boiling point of water at atmospheric pressure and at a temperature and pressure which maintains water in liquid state, the temperature being below the deterioration temperature of the polymer, extruding said melt through a spinneret to form filaments, and stretching the resulting filaments to provide molecular orientation.

Surprisingly, the process does not cause any significant reduction in the molecular weight of the polymer in spite of the fact that water is used in preparing the polymer melt at high temperature and pressure. It is also surprising that adequate molecular stretching of the polymer molecules can be achieved without conducting such stretching in a steam-pressurized environment. In spite of the fact that the nascent filaments are solidified without the benefit of a steam-pressurized solidification zone, it is also surprising that fiber obtained does not have a sheath-core structure and the undesirable properties associated therewith.

The process of the present invention enables poly(polymethylene terephthalamides) to be spun at a temperature safely below their deterioration points and does not require undesirable polymer solvents to liquify the polymer. As a result, the process of the present invention represents an attractive route for the preparation of poly(polymethylene terephthalamide) fibers and encourages advantage to be taken of the desirable properties of such fibers.

The poly(polymethylene terephthalamides) useful in the process of the present invention have the structural formula in which the repeating units comprise

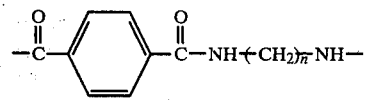

wherein n is an integer of about 2 to 12, preferably about 4 to 8, and more preferably 6. Polymers containing such repeating units may be made by polycondensation of terephthalic acid and a polymethylene diamine according to conventional procedures. Co-reactants such as caprolactam and the like may be used to provide additional repeating units in the polymer in amounts which do not detract from desirable properties of the resulting fiber, Certain of the co-reactants may be used to lower the melting point of the resulting polymer or to provide other features not available from the combination of terephthalic acid and polymethylene diamine alone. The polymers may be prepared in bulk or in other conventional forms. Since such polymers and copolymers are known, further discussion of their preparation and nature is unnecessary. Useful polymers of the type described will generally have molecular weights in the range of about 6,000 to about 100,000 or more, usually about 10,000 to 50,000.

In carrying out processing in accordance with the process of the present invention, it is first necessary to prepare a homogeneous single phase fusion melt of a poly(polymethylene terephthalamide) and water. The amount of water necessary to provide the homogeneous single phase fusion melt will generally be in the range of about 5 to 25% by weight based on the total weight of polymer and water, a preferred range being from about 7 to 15%, same basis. Typically solid polymer is blended with the water and the polymer absorbs the water so that a wetted polymer solid arises. This wetted polymer solid is then processed to a melt usually by means of a screw extruder. The extruder heats and compresses the polymer-water composition and delivers the homogeneous single phase fusion melt at appropriate temperature and pressure, usually above autogenous pressure, for extrusion. As indicated, the polymer-water composition will form the desired melt at a temperature above the boiling point of water at atmospheric pressure and at a temperature below the deterioration temperature of the polymer. In order to maintain water in liquid state at least autogenous pressure is required and higher pressures will generally arise due to compression. In order to find the proper amounts of water to employ and the useful melt temperature, it is convenient to construct a phase diagram of the polymer-water composition. It is generally preferable to prepare the melt at a temperature at least about 10° C. above the minimum melting point of the polymer-water composition in order to ensure homogeneity of the melt. At temperatures above the minimum melting point of the polymer-water composition, there will be a range of water contents which will provide a single phase melt and greater leeway in water content is possible. The specific amount of water useful with the polymer class will vary somewhat depending upon the composition of the polymer, its molecular weight, the operating conditions, and the like. Typically, the melt is formed at a temperature in the range of about 170–250° C., preferably about 180–220° C.

After the homogeneous single phase fusion melt is prepared, it is melt extruded through a spinneret to form filaments. Usually, the pressure generated within the extruder is sufficient for extrusion but additional pumps or pressure devices may be used, if desired. The spinneret should contain fiber-forming orifices of suitable size to provide filaments of textile denier upon completion of processing. The extrusion may be directly into the atmosphere or into such other environments as may be desired.

After the filaments have been formed by extrusion, they are subjected to stretching to provide molecular orientation. Such stretching results in improved physical properties of the filaments and also results in size reduction.

While it is possible to provide fiber of good physical properties by extruding the single phase melt into the atmosphere, it is generally preferred to extrude the melt into a steam-pressurized solidification zone maintained with saturated steam at a temperature which is about 10° C. to about 50° C. below the minimum melting temperature of the polymer-water composition since such processing enables a higher degree of stretching to be achieved while the filaments remain within the solidification zone. When stretching is conducted on filaments formed in the atmosphere, it is usually obtained by drawing over a heated surface such as a platen, pin, or roll. This type of stretching may also be accomplished by spinning into heated air alone or in conjunction with drawing over a heated surface. It is also possible to effect improved stretching by extruding the filaments into hot water which can also regulate release of water from the extrudates.

Although no further processing of the filaments is necessary to carry out the process of the present invention, it is usually desirable to dry the filaments under controlled conditions of temperature and humidity to improve their transparency. This is preferably conducted at dry bulb temperatures in the range of 110 180° C. and wet bulb temperatures in the range of about 60 to 100° C.

After drying, it is also preferred to relax the filaments in steam under pressure so as to effect shrinkage to about 5 to 40% since this processing tends to provide a favorable balance of physical properties.

The invention is more fully illustrated in the examples which follow wherein all parts and percentages are by weight unless otherwise specified .

EXAMPLE 1

Poly(hexamethylene terephthalamide), nylon 6T, of 1.7 relative viscosity as determined in sulfuric acid, was prepared as a fine powder of less than 100 micron particle size. Water in the amount of approximately 20% of the combined weight was physically admixed with the polymer to provide a free-flowing, dry-appearing powder. This material was formed into dense cylindrical pellets of 9.5 millimeters diameter weighing approximately 2.5 grams and containing 19% water. These pellets were charged to an Instron capillary rheometer equipped with a single 85 micron diameter spinneret capillary and protective filter pack. The rheometer temperature was 200° C. The rheometer barrel was immediately sealed after charging of the pellets by means of the piston rod and the charge was held under approximately 500 psi pressure for 5 minutes. At the end of time, the piston drive was engaged to deliver polymer-water melt through the capillary at a linear velocity of about 9 meters per minute. A clear filament emerged which could be drawn down (stretched) in air by hand from the spinneret capillary in the manner typical of fiber-forming melts. The extruded filament had a polymer content which had undergone negligible change in molecular weight from that of the starting polymer when analyzed for relative viscosity.

EXAMPLE 2

The polymer of Example 1 was prepared as a coarse granulate with particle size in the range of 0.25–0.75 millimeters. This granulate was admixed with water in a double cone blender at room temperature to yield a free-flowing, dry-appearing solid with approximately 8% water content. This material in the form of pellets was extruded on the Instron rheometer at 200° C. through a single 200 micron spinneret capillary at 5 meters per minute linear velocity to give a transparent filament showing the same excellent draw down in air as the filament of Example 1. The apparent melt viscosity was measured at an apparent shear rate of 10,000 reciprocal seconds and was found to be approximately 1600 poise.

EXAMPLE 3

The polymer of Example 2 was supplied to a ¾ inch single screw extruder connected by melt delivery hardware to a spinneret. The spinneret discharges into a steam chamber which contains three stages of stretch rolls and a sealing device to permit exit of drawn yarn to an external collection device.

With the extruder first being supplied with an acrylonitrile "start-up" polymer containing about 15% water and stably delivering hydrated acrylonitrile polymer melt to the spinneret, the hydrated polymer of Example 2 is added to the feed hopper. A progressive transition from 100% acrylonitrile polymer-water to 100% nylon 6T-water is made, and extruder temperatures are adjusted to achieve a melt temperature of 200° C.

The hydrated nylon 6T melt is delivered at a rate of 7.4 grams per minute to the spinneret containing 37 capillaries each of 200 micron diameter. With the steam chamber pressurized to 10 psig with saturated steam, the spun filaments are stretched at a total stretch ratio of 60 to give a tow of 150 total denier, or 4.1 denier per filament. On the Instron tensile testing machine, this tow was found to have a breaking tenacity of approximately 2 grams per denier and ultimate elongation of approximately 20%.

EXAMPLE 4

The procedure of Example 3 is repeated in every material detail except the steam chamber is left open to the atmosphere and no stream is admitted thereto. It is found that the spun filaments show good draw down attenuation in air, giving stretch ratios of at least 10X and the resulting filament can be subsequently stretched further by passing it over a heated surface.

In each of the examples given above, the fiber obtained had a homogeneous transparent structure without any evidence of sheath-core structure.

We claim:

1. A process for preparing fiber which comprises preparing a homogeneous single phase fusion melt of a poly(polymethylene terephthalamide) and water at a temperature above the boiling point of water at atmospheric pressure and at a temperature and pressure which maintain water in liquid state, the temperature being below the deterioration temperature of the polymer, extruding said melt through a spinneret to form filaments, and stretching the resulting filaments to provide molecular orientation.

2. The process of claim 1 wherein said poly(polymethylene terephthalamide) is poly(hexamethylene terephthalamide).

3. The process of claim 1 wherein said extruding is directly into a steam-pressurized zone wherein said stretching step is conducted.

4. The process of claim 2 wherein the water content of the polymer-water melt is about 7–15%.

5. The process of claim 4 wherein the melt temperature is about 180–220°.

* * * * *